US005439103A

United States Patent [19]

Howes

[11] Patent Number: 5,439,103

[45] Date of Patent: Aug. 8, 1995

[54] PRIZE HOLDING CONTAINER ASSEMBLIES

[76] Inventor: James P. Howes, 122 St. Johns Rd., Wilton, Conn. 06498

[21] Appl. No.: 238,015

[22] Filed: May 3, 1994

[51] Int. Cl.[6] ..... B65D 23/00

[52] U.S. Cl. ..... 206/217; 206/457; 215/6; 215/227; 220/694; 340/384.7; 340/815.69

[58] Field of Search ..... 206/217, 457, 459.1; 215/6, 227; 220/694; 340/815.69, 384.72, 384.7

[56] References Cited

U.S. PATENT DOCUMENTS

| | | | |
|---|---|---|---|
| 4,607,747 | 8/1986 | Steiner | 206/232 |
| 4,631,715 | 12/1986 | Hoover | 206/217 |
| 4,688,023 | 8/1987 | McGill et al. | 206/459.1 |
| 4,911,320 | 3/1990 | Howes | 206/217 |
| 5,046,631 | 9/1991 | Goodman | 220/694 |
| 5,056,659 | 10/1991 | Howes et al. | 206/831 |
| 5,099,232 | 3/1992 | Howes | 206/217 |
| 5,283,567 | 2/1994 | Howes | 206/217 |

*Primary Examiner*—Jimmy G. Foster
*Attorney, Agent, or Firm*—Melvin I. Stoltz

[57] ABSTRACT

By providing an audible and/or visual prize related message delivery system cooperatingly associated with a container shell which is closed in the conventional manner, a container assembly is achieved for randomly distributing prize awards to consumers in association with any product, without fear of consumer detection of the prize bearing containers. In accordance with the present invention, the container assembly may incorporate the actual product along with the prize related message delivery system or may comprise a simulated product container bearing the prize related message delivery system without the actual product. In both embodiments, the container assembly is completely indistinguishable from non-prize bearing, product-holding containers.

18 Claims, 6 Drawing Sheets

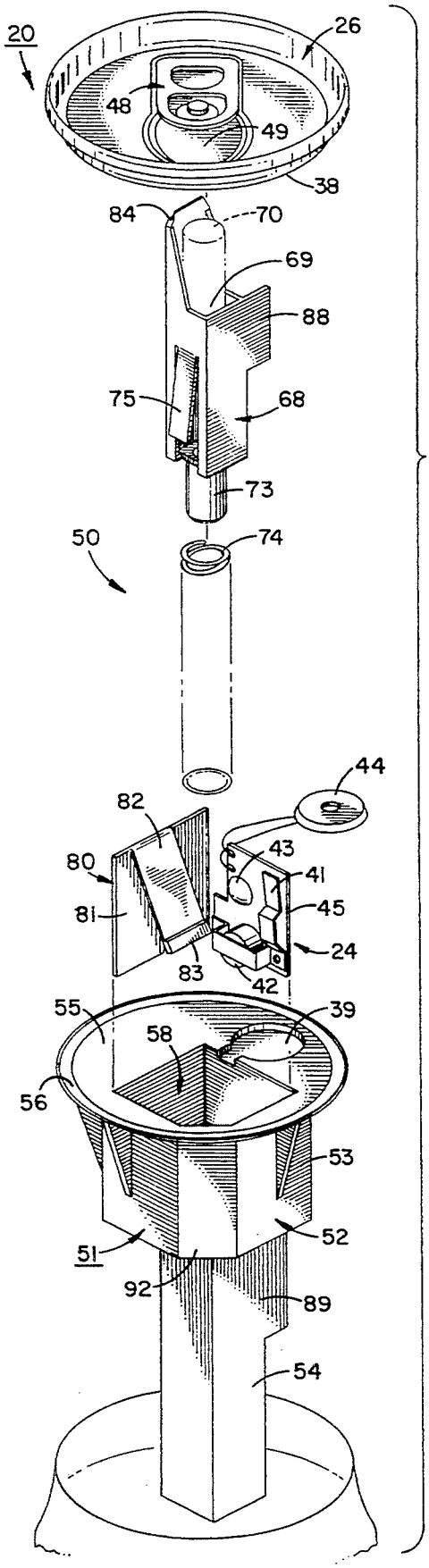
FIG. 1
FIG. 2
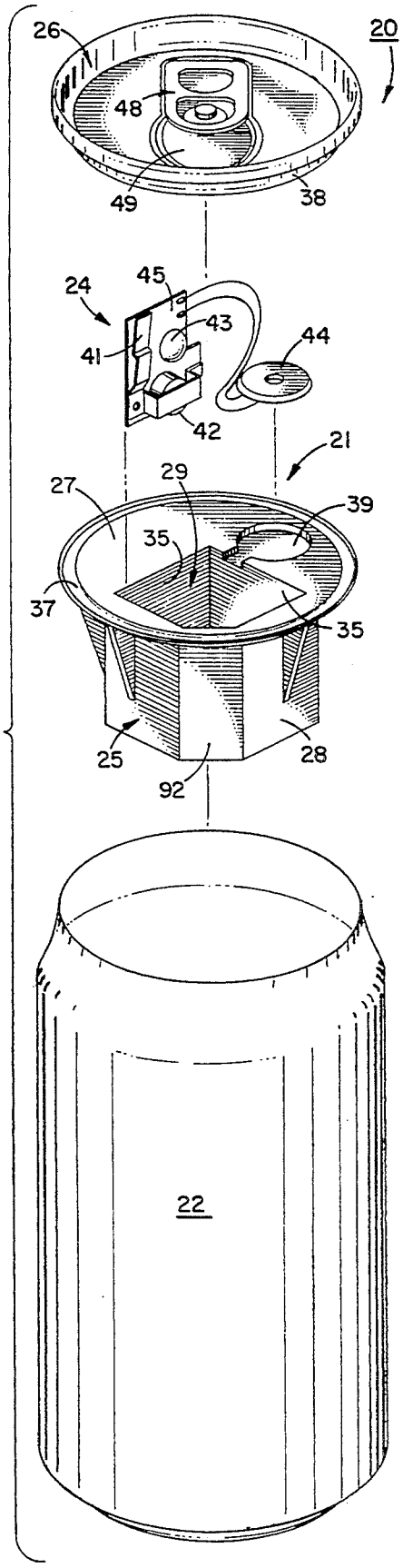

FIG. 7
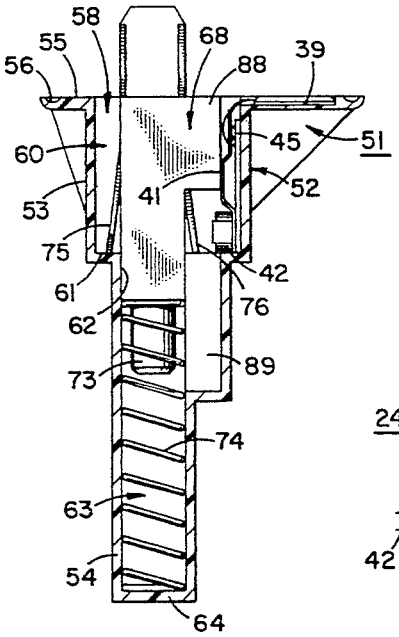
FIG. 4
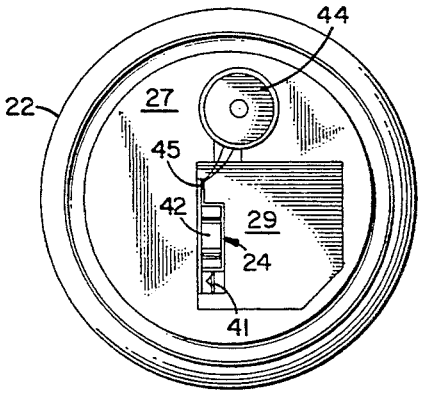
FIG. 3
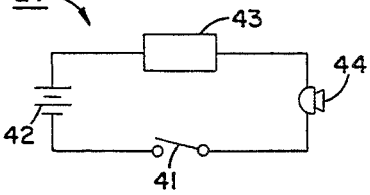
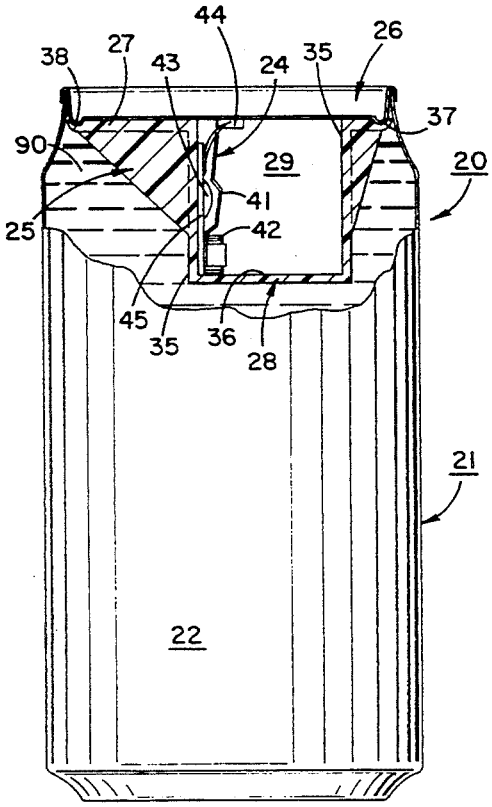
FIG. 5
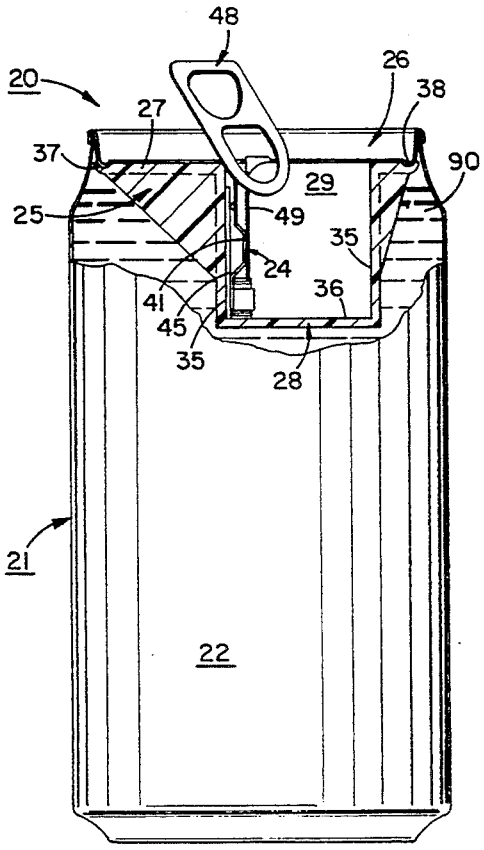
FIG. 6

FIG. 8
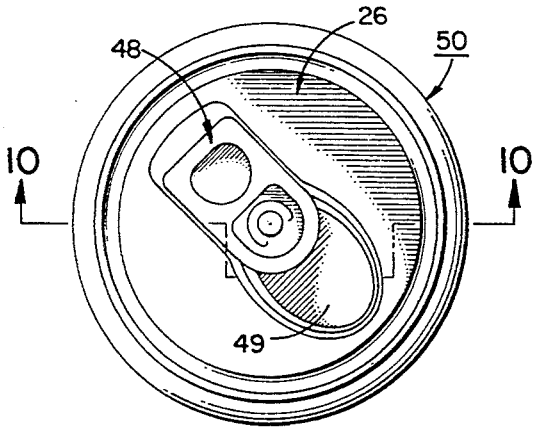
FIG. 9
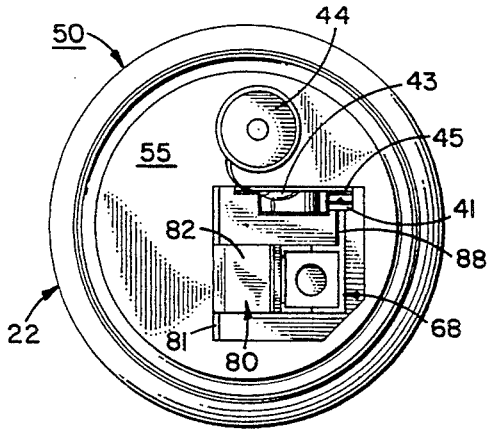
FIG. 12
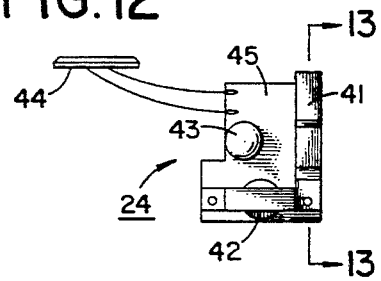
FIG. 13
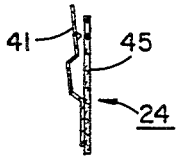
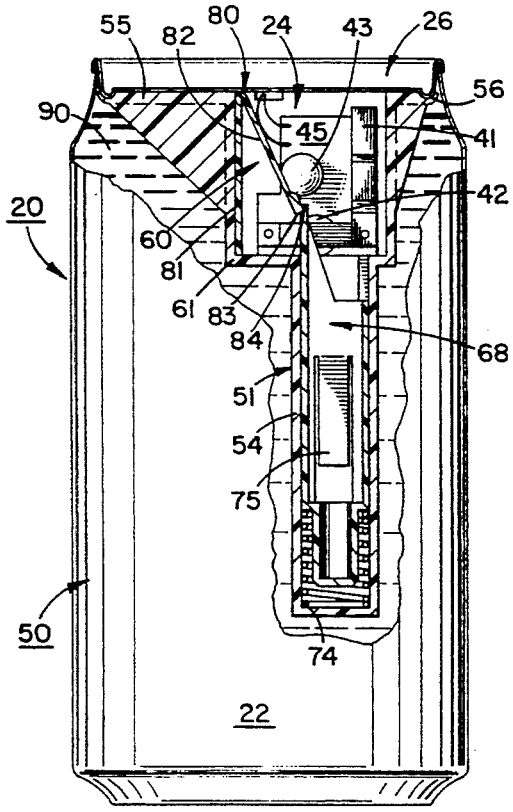
FIG. 10
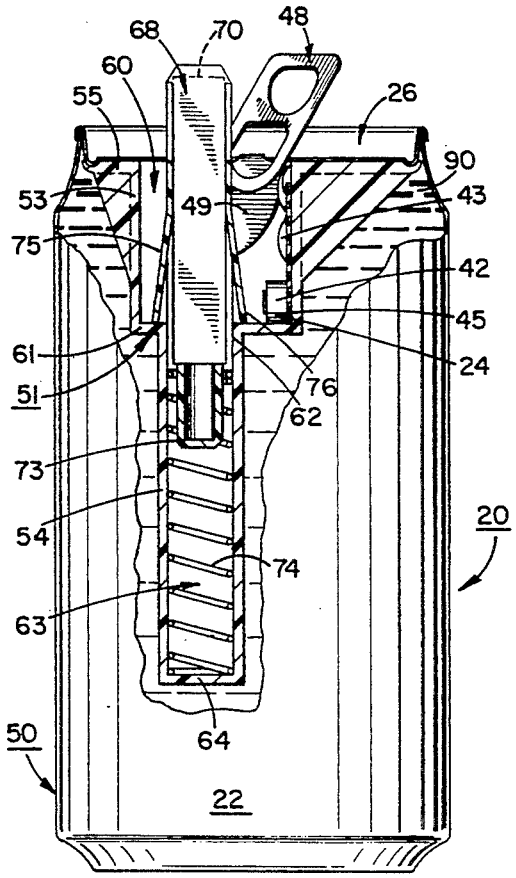
FIG. 11

PRIZE HOLDING CONTAINER ASSEMBLIES

TECHNICAL FIELD

This invention relates to product containers constructed for secretly retaining an audible or visual prize related message delivery system and, more particularly, to product containers for any product including liquid, semi-liquid, or moist products, constructed for secretly retaining the message delivery system either independently or in conjunction with an actual prize award while being distinguishable from non-prize bearing product containers.

BACKGROUND ART

The use of various promotional enhancements for increasing the sale of particular products is commonly employed by manufacturers or distributors for a wide variety of products. These promotional enhancements take on a variety of forms, all for the purpose of increasing product sales.

One of the promotional methods often employed by manufacturers is the inclusion of a prize in either every product container or in selected containers. In order to attain greater market share for product sales, manufacturers and distributors have utilized a variety of different promotional themes in order to generate added sales for their particular products. In doing so, the premium or prize-like promotion has progressed from inexpensive give-aways packed in every product bearing container to expensive prize awards which are packed in selected containers, which containers are randomly distributed with non-prize bearing containers.

However, no prior art promotional effort has ever employed an audible and/or visual message delivery system as the means for announcing the prize award or as an accompaniment to the prize award, in order to further enhance the excitement and thrill of winning a prize.

Furthermore, due principally to the difficulties of contamination, product degradation, or prize degradation, even known prior art incentive programs have not been employed by manufacturers or distributors of wet or moist products. As a result, liquid food products such as soda, water, beer, juice, and the like and moist food products, such as yogurt, cottage cheese, sour cream, jellies, jams, peanut butter, dips, canned fruits, vegetables and the like, have been incapable of employing even the prior art promotional sales incentives.

In addition, other wet or moist consumable goods such as detergents, soaps, bleaches, automotive oils, polishes and the like have been unable to employ prior art product promotional techniques. As a result of this inability, these manufacturers or distributors have been incapable of employing an effective product sales incentive in order to generate increased interest and sales of their respective products.

Consequently, it is a principal object of the present invention to provide a prize award container assembly for use with any consumer product which incorporates a prize related message delivery system providing the consumer with a visual or audible prize related message.

Another object of the present invention is to provide a prize award container assembly having the characteristic features described above, which also incorporates an actual prize award therewith.

Another object of the present invention is to provide a prize award container assembly having the characteristic features described above, which is employed in conjunction with liquid, semi-liquid or moist products.

A further object of the present invention is to provide a prize award container assembly having the characteristic features described above, wherein the container assembly comprises a simulated product container identical in all respects to a genuine product container but contains only the prize related message delivery system.

Another object of the present invention is to provide a prize award container assembly having the characteristic features described above, which incorporates the outer shell of the genuine product being simulated, while comprising within the container assembly means to simulate both the feel and sound of the genuine product being simulated.

A further object of the present invention is to provide a prize award container assembly having the characteristic features described above, which is virtually indistinguishable from actual product bearing containers being simulated intended to display with the product bearing containers without being detected.

Another object of the present invention is to provide a prize award container assembly having the characteristic features described above, wherein the prize related message delivery system is activated upon the opening of the container.

Other and more specific objects will in part be obvious and will in part appear hereinafter.

SUMMARY OF THE INVENTION

By employing the present invention, the failure of prior art systems to provide added excitement to the thrill of winning a prize award as well as the inability of the prior art systems to enable prize incentives or premium promotions to be used with liquid, semi-liquid or moist products are all completely overcome. In one embodiment of the present invention, a visual or audible prize related message delivery system is mounted within a product container for being activated upon the opening of the product. In this way, a prize award announcement can be made informing the consumer of the actual prize that has been won or, alternatively, the message delivery system can incorporate musical background or a visual display to accompany the winning of a prize which is actually mounted within the product container in association with the message delivery system. In this way, the thrill and excitement of winning a prize award is further enhanced and made more important and significant.

In another embodiment of the present invention, replicated or simulated product containers are employed to house the prize related message delivery system either individually or in association with an actual prize being awarded. Regardless of which configuration is employed, the simulated product containers are constructed to be identical to the genuine product containers in all consumer discernible respects prior to the opening of the container. It this way, the simulated product containers of the present invention are indistinguishable from the conventional product-bearing containers by external analysis. As a result, the simulated product containers can be randomly distributed with genuine, product bearing containers with complete assurance that the prize bearing containers cannot be purposefully preselected by a consumer in order to obtain the prize award contained therein.

By employing this embodiment of the present invention, simulated, prize bearing containers are randomly distributed with genuine, product bearing containers for being similarly randomly selected by consumers who are sufficiently lucky to win the prize award contained therein. Only upon opening the simulated product container is the consumer aware that a prize award has been won, with this embodiment of the present invention providing the consumer with a prize related visual or audible message as either the means for announcing the prize award, or as the means for accompanying the actual prize award as a further enhancement to the moment when the consumer realizes that a prize award has been won.

Regardless of which embodiment of the present invention is employed, locking systems are incorporated within the product containers to prevent inadvertent or unwanted activation of the message delivery system prior to opening the prize bearing container in the normal fashion as if the product were to be dispensed therefrom. In this way, any consumer seeking to determine a prize bearing container from the genuine product bearing container will be unable to activate the system while on the store shelves, without actually destroying the integrity of the container.

In addition to providing the unique, audible or visual prize related message delivery system in a product container, the present invention attains for the first time the ability for manufacturers and distributors of liquid, semi-liquid, or moist products to employ this unique incentive promotion. Regardless of whether the products are for human consumption or for other purposes, such as liquid detergents, soaps, bleaches, washing compositions, automotive oils, lubricants, and the like, these wet or moist products can also employ the teaching of the present invention in order to attain the unique prize incentive promotion for enhancing product sales depending upon the type of wet or moist product being sold, the unique product construction of the present invention can be employed along with the actual product or with the product being simulated, as detailed above.

The invention accordingly comprises a product possessing the features, properties and the relation of components which will be exemplified in the products hereinafter described and the scope of the invention will be indicated in the claims.

DESCRIPTION OF THE DRAWINGS

For a fuller understanding of the nature of the objects of the invention, reference should be had to the following detailed description, taken in connection with the accompanying drawings, in which:

FIG. 1 is an exploded perspective view of one embodiment of the prize awarding container of the present invention incorporating a message delivery system therein;

FIG. 2 is an exploded perspective view of an alternate embodiment of the prize awarding container of the present invention also incorporating the message delivery system of this invention;

FIG. 3 is a schematic view of the message delivery system of the present invention;

FIG. 4 is a top plan view of the prize awarding container embodiment of FIG. 2 depicted with the lid removed and with the message delivery system in the normal, off position;

FIG. 5 is a side elevation view, partially broken away and partially in cross-section, of the prize awarding container embodiment of FIG. 2, Shown with the message delivery system in the "off" position;

FIG. 6 is a side elevation view, partially broken away and partially in cross-section, showing the prize awarding container embodiment of FIG. 2 with the message delivery system activated;

FIG. 7 is a cross-sectional, side elevation view of the housing assembly employed in the prize awarding container embodiment of FIG. 1, with the message delivery system incorporated therein depicted in its activated condition;

FIG. 8 is a top plan view of the prize awarding container embodiment of FIG. 1;

FIG. 9 is a top plan view of the prize awarding container embodiment of FIG. 1 depicted with the lid removed and with the message delivery system in its normal, off position;

FIG. 10 is a side elevation view, partially in cross-section and partially broken away, taken along line 10—10 of FIG. 8 depicting the prize holder in its retained position;

FIG. 11 is a side elevation view, partially in cross-section and partially broken away, of the prize awarding container embodiment of FIG. 1, depicting the prize holder in its released position;

FIG. 12 is a top plan view of the message delivery system of the present invention;

FIG. 13 is a cross-sectional side view taken along line 13—13 of FIG. 12;

DETAILED DISCLOSURE

Figure 14:
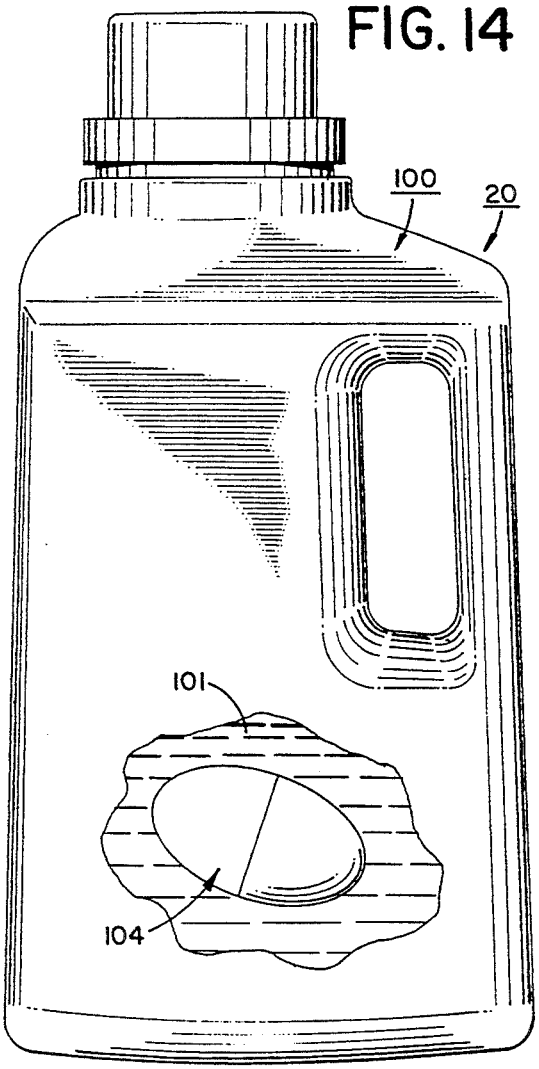
FIG. 14 is a front elevation view, partially broken away, of an alternate embodiment of the prize awarding container of the present invention.
Figure 17:
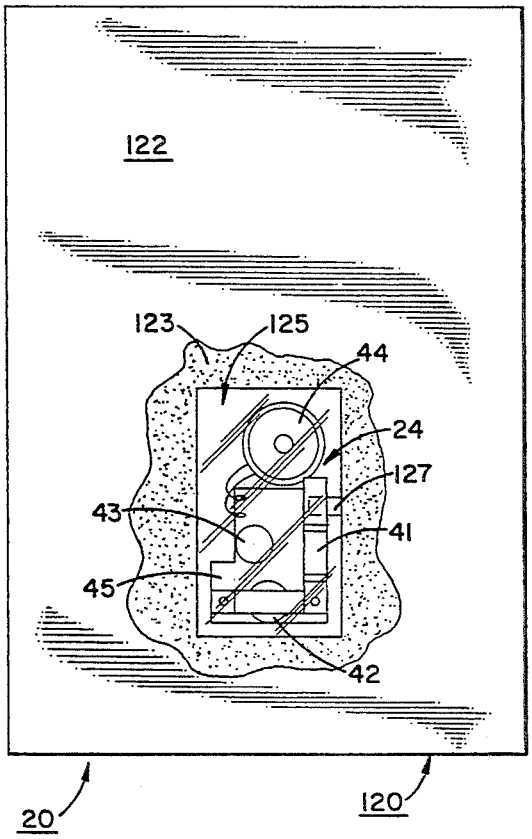
FIG. 17 is a front elevational view, partially broken away, of a further alternate embodiment of the prize awarding container of the present invention depicting a message delivery system mounted therein in direct association with a dry product.

In FIGS. 1 and 2, the prize awarding product containers of the present invention are shown as simulated product container assemblies, while FIGS. 14, 17 and depict the prize awarding product container of this invention as actual product holding container assemblies. In the following disclosure, each of these embodiments are fully disclosed in detail.

In FIGS. 2–6, prize awarding product container 20 is depicted as simulated product container assembly 21 comprising an outer shell 22, which is identical in form and appearance to the conventional product holding container, which simulated product container assembly 21 is intended to emulate.

Although simulated product container assembly 21 is depicted as a conventional liquid holding can, typically employed for beverages such as soda, beer, juices, etc., simulated product container assembly 21 contains no consumable liquid. Instead, in this embodiment, container assembly 21 houses an audible or visual message delivery assembly 24 which is automatically activated upon the opening of container assembly 21, immediately informing the consumer that a prize has been won, as well as providing information concerning the particular prize award.

In order for simulated product container assembly 21 of the present invention to be completely indistinguishable from the conventional liquid holding can which it is intended to simulate, simulated product container assembly 21 must comprise not only the identical external appearance, but must also be identical to the conventional liquid holding can in both sound, weight and feel.

In order to attain the virtual identity, simulated product container assembly 21 comprises an outer can shell 22 which is identical to the can shell employed by the manufacturer or bottler for the consumable liquid-holding can which simulated product container assembly 21 constructed to represent. However, instead of being sold with the consumable liquid housed therein, shell 22 contains a non-consumable liquid identical in weight, feel and sound to the consumable liquid. In addition, the simulating liquid is sealingly enclosed within shell 22, to prevent its accidental use.

In order to attain this embodiment of the present invention, simulated product container assembly 21 comprises shell 22, audible/visual message delivery system 24, housing 25, and lid 26. Preferably, housing or holding member 25 comprises a substantially circular, flat, sealing flange 27 and a chamber 28 extending from one surface of flange 27 and defining an enlarged cavity 29 having its entry portal through flange 27.

Cavity 29 of chamber 28 is defined by peripherally surrounding walls 35 and base 36. In addition, sealing flange 27 of housing 25 incorporates peripherally surrounding circular sealing groove 37 which is formed in the top surface thereof and positioned for secure, bonded, fixed interengagement with a mating sealing ring portion 38 of lid 26.

As shown schematically in FIG. 3 and illustratively in FIGS. 1, 2, 12 and 13, audible/visual message delivery system 24 comprises a switch 41, a battery 42, an integrated circuit 43, and an amplifier 44. In one embodiment, integrated circuit 43 comprises a conventional, well-known circuit constructed for producing tones in a pre-defined sequence corresponding to a particularly desired song or melody. In addition, in the preferred construction, switch 41, battery 42, and integrated circuit 43 are all mounted on the same printed circuit board 45, thereby establishing a small, compact construction which is easily mountable in cavity 29, preferably on a wall 35 thereof.

In addition, amplifier 44 is preferably mounted in holding recess 39 formed in flange 27 to assure that amplifier 44 is in contact with lid 26. Alternatively, amplifier 44 may be mounted directly to lid 26. In both constructions, the mounting of amplifier 44 in contacting engagement with lid 26 assures that any audible message generated by integrated circuit 43 is clearly and completely heard by the consumer whenever message delivery system 24 has been activated.

By employing this embodiment of the present invention, inexpensive, commercially available integrated circuits can be employed to generate one or more of a plurality of different songs. By preselecting specific songs or song combinations to represent particular prize awards, the consumer immediately knows the prize that has been won by the songs or medleys generated by message delivery system 24.

In an alternate embodiment, specially constructed integrated circuits are employed which produce a synthesized voice message informing the consumer of the particular prize that has been won. If desired, songs or background music can also be generated by message delivery system 24 to further enhance the excitement attained by the consumer upon learning that a prize has been won.

As a further means for adding excitement to the moment a consumer realizes that a prize awarding container has been opened, message delivery system 24 may also incorporate one or more LED's or other light source to provide a light display ranging from a single blinking light as the sole message to a fully integrated, multi-color illumination display timed to the music and the voice message which communicates the prize that has been won. In addition, message delivery system 24 can be constructed to continuously repeat the audible or visual message, until battery power is lost, or constructed to provide the message a single time or repeat the message any desired number of times. Consequently, message delivery system 24 may be selected from a wide range of alternate constructions or combinations, without departing from the scope of this invention.

Regardless of the particular embodiment employed, message delivery system 24 is securely contained within chamber 28 of housing 25 with switch 41 thereof being normally positioned in the open or "off" position, preventing any message from being delivered by message delivery system 24. This position is shown in FIGS. 4 and 5. In addition, simulated product container 21 is constructed to assure that changes in ambient or external conditions, such as temperature changes and vibrations normally encountered in handling, storing, shipping and delivering of the product to the consumer have no deleterious effect on message delivery system 24.

In particular, the entire construction of simulated product container 21 is based upon preventing any unwanted activation of message delivery system 24 prior to opening tab release assembly 48 of lid 26. However, as shown in FIG. 6, when tab release assembly 48 is opened, flap 49 pivots inwardly into cavity 29 of chamber 28. This movement causes flap 49 to abuttingly contact switch arm 41, causing switch arm 41 to be moved from its open or "off" position to its closed or "on" position, completing the circuit of message delivery system 24. Once activated, the desired message is delivered to the consumer.

In FIGS. 1, and 7 through 11, a further alternate embodiment for prize awarding product container 20 of the present invention is shown in detail. In this embodiment, simulated product container assembly 50 is constructed in a manner similar to the simulated product container assembly 21. However, simulated product container assembly 50 is constructed for Secretly retaining an actual cash prize or prize certificate in addition to audible/visual message delivery system 24.

As with the previous embodiment detailed above, simulated product container assembly 50 comprises an outer shell 22 which is identical in form and appearance to the conventional consumable liquid holding can which container assembly 50 is intended to simulate. In addition, lid 26 comprises the identical construction and configuration employed for the lid of the conventional container. As detailed below, prior to sealingly mounting lid 26 to outer shell 22, shell 22 is filled with a suitable liquid which effectively fills simulated product container assembly 50, providing the desired weight, feel, and sound, rendering simulated product container assembly 50 completely indistinguishable from a genuine product container.

As best seen in FIGS. 1, 7, 10, and 11, holding member or housing 51 comprises an elongated, two-tier chamber assembly 52, formed by an upper enlarged cavity 53, and a lower, elongated, closed end conduit 54 communicating at its open end with the base of upper enlarged cavity 53. In addition, holding member or housing 51 incorporates a circular, substantially flat upper flange 55 formed about the top of cavity 53. Flange 55 is peripherally surrounded by a circular sealing groove or channel 56, and incorporates an enlarged portal zone 58 formed therein, which comprises the portal opening to upper enlarged cavity 53.

Upper enlarged cavity 53 incorporates a substantially open zone 60 extending from portal opening 58 to base 61 of cavity 53. In addition, base 61 incorporates a portal 62 formed therein which forms the entry to elongated open zone 63 of conduit 54. In order to assure that open zones 60 and 63 remain completely free of any unwanted liquid, elongated conduit 54 comprises an end closing base 64 which sealingly closes zone 63, assuring that the interior surfaces and open zones of two-tier chamber assembly 52 remain completely dry.

In the preferred embodiment, a prize holding assembly is securely mounted in the open zones of two-tier chamber assembly 52. In this embodiment, a prize holder 68 is employed which incorporates a substantially rectangular shape and has an elongated, open ended cavity 69 formed therein in which the desired prize award is securely retained. In the drawings, the prize award is depicted in phantom, as a rolled currency 70. Of course, as discussed above, the prize award can comprise any desired currency amount or a certificate awarding a particular prize to the winner.

As shown throughout the referenced drawings, prize holder 68 incorporates a size and shape constructed for providing free, sliding, mating, telescoping engagement of holder 68 in open zone 63 of conduit 54. In addition, in order to provide the desired automatic sliding movement of prize holder 68 from a first retained position to a second fully extended position, prize holder 68 incorporates a post 73 extending from the base of prize holder 68, which is dimensioned for peripherally surrounding and matingly engaging with spring means 74.

Prize holder 68 also incorporates outwardly biased, spring arm members 75 and 76 formed on opposed sides of holder 68. Spring biased arms 75 and 76 assure that prize holder 68 is securely retained in its second, fully extended position, once simulated product container 50 has been opened.

As clearly shown in FIG. 11, when prize holder 68 is released for movement from its retained position into its fully extended position, a portion of prize holder 68 extends through the portal opening formed in lid 26 by the removal of flap 49 of tab release assembly 48. When in this second position, spring biased arms 75 and 76 move outwardly from their stowed position, adjacent the walls of conduit 54, to their fully extended position, lockingly engaging arms 75 and 76 on base 61 of upper cavity 53. In this way, prize holder 68 is securely locked in its fully extended, prize presenting position, assuring immediate access by the consumer to the prize award retained in holder 68, as well as assuring that the simulated product container 50 can be employed only one single time, and not reused.

In addition to presenting the consumer with the actual prize award, this embodiment of the present invention also incorporates an audible and/or visual message delivery system 24. Preferably, message delivery system 24 is constructed substantially identical to the construction detailed above, with a switch 41, battery 42, and integrated circuit 43, all mounted on printed circuit board 45. In addition, an amplifier 44 is connected to message delivery system 24 and is mounted on flange 55, in contact with lid 26.

In the preferred construction, integrated circuit 43 comprises an inexpensive tone generating chip which is pre-programmed to produce a particular song or melody when activated. Since simulated product container assembly 50 incorporates the actual prize award, message delivery system 24 is employed to further enhance the excitement and thrill of winning a prize by providing a musical background, precisely at the moment the consumer opens container assembly 50. Of course, if any other integrated circuit is desired, such as multiple tunes, melodies, multiple tones, or synthesized voice messages, this embodiment may be employed without departing from the scope of this invention. In addition, light sources can also be employed, separately or in combination, with an audible message, if desired.

In the preferred construction, message delivery system 24 is mounted in cavity 53 on one of the inside walls thereof. As fully detailed below, switch means 41 of message delivery system 24 is positioned for automatic activation by the movement of position aligning and stabilizing fin 88 formed on prize holder 68. In this way, whenever prize holder 68 is released and moves into its second, prize presenting position, as shown in FIG. 7, fin 88 automatically moves switch arm 41 from its "off" position to its "on" position, activating message delivery system 24 to provide the desired visual and/or audible message.

In order to assure that prize holder 68 is securely retained in its first, position and enable prize holder 68 to automatically move into its second, fully extended, prize presenting position when simulated product container 50 is opened, prize holder locking means 80 is employed. As shown in FIGS. 1 and 10, prize holding locking means 80 incorporates a position establishing stabilizing plate 81 and a spring biased flexible arm 82 extending from the upper edge of plate 81. Arm 82 incorporates a holder engaging edge 83 formed at the distal end of flexible arm 82. In order to assure that arm 82 of locking means 80 securely holdingly engages and retains prize holder 68, prize holder 68 incorporates a lock receiving ledge 84 formed along an outer surface thereof near its upper end, for mating contacting engagement with edge 83 of arm 82.

Locking means 80 is securely positioned within open zone 60 of upper enlarged cavity 53, with stabilizing plate 81 positioned in secure abutting contact with a side wall of cavity 53. In this way, flexible arm 82 extends from stabilizing plate 81 with engaging edge 83 thereof positioned in secure, locking, retaining engagement with ledge 84 of prize holder 68. In this way, prize holder 68 is securely retained in its first position in elongated conduit 54, with spring 74 fully compressed, ready to propel prize holder 68 upwardly, when released.

With prize holder 68 securely locked in its first position, simulated product container assembly 50 is able to withstand all of the various temperature changes and handling conditions typically experienced during handling, storing, shipping, delivering and distributing the product. By employing this construction, it has been found that simulated product container assembly 50 is easily randomly distributed with genuine product bearing containers, with prize holder 68 being securely retained in its first position throughout the distribution cycle, until simulated product container assembly 50 is open by a consumer. As a result, consumers are able to randomly choose simulated, prize holding container assembly 50, without in any way suspecting that the container selected houses a prize award.

In addition to assuring that prize holder 68 is securely held in its first, retained position throughout the distribution cycle, this embodiment of the present invention also assures that prize holder 68 is automatically released from its first retained position whenever tab assembly 48 of lid 26 is employed to open simulated product container assembly 50. When tab assembly 48 is raised away from the top surface of lid 26, pre-cut end portion or flap 49 automatically folds downwardly into open zone 60 of cavity 53.

As part of this arcuate movement, flap 49 contacts arm 82 of locking means 80, causing arm 82 to move towards plate 81. In doing so, engaging edge 83 is displaced from secure, locked engagement with ledge 84 of prize holder 68, releasing prize holder 68 from its first, securely retained position and allowing prize holder 68 to be longitudinally propelled upwardly by spring means 74 into its second, fully extended position, depicted in FIG. 11. In this way, the consumer becomes immediately aware that a prize has been won, with prize 70 being presented to the consumer through the opening formed in lid 26.

In order to assure that prize holder 68 telescopically advances along the central axis defined by elongated conduit 54 and activates message delivery system 24, while also being precisely positioned for passage through the opening in lid 26 formed by the removal of flap 49, prize holder 68 incorporates a position aligning and stabilizing fin 88 extending outwardly from one surface thereof. In addition, elongated conduit 54 of two-tier chamber assembly 52 incorporates a fin receiving slot 89 constructed for sliding receipt and controlled orientation of prize holder 68.

Position aligning and stabilizing fin 88 extends substantially perpendicularly from one side surface of prize holder 68 and is slidably retained within fin receiving slot 89. Although prize holder 68 is preferably constructed with a substantially rectilinear configuration, in order to avoid unwanted rotation of the prize holder, fin 88 assures that prize holder 68 does not rotate about its central axis as prize holder 68 telescopically advances between its first retained position to its second fully extended position.

In addition, as prize holder 68 moves from its first position into its second, fully extended position, fin 88 moves into engagement with switch 41 of message delivery system 24, causing switch 41 to be moved into its "on" position. As a result, the consumer simultaneously sees a prize award in holder 68, while also having message delivery system 24 activated to provide the desired visual and/or audible message.

As shown in FIG. 7, fin 88 is also constructed to maintain switch 41 in its "on", position, thereby providing the consumer with a repeating audible or visual message. In this way, the consumer can continue to enjoy the thrill and excitement of winning a prize award for an extended time period.

Furthermore, fin 88 increases the overall width of the side edges of prize holder 68, thereby preventing the entire prize holder from passing through the opening formed in lid 26 by the removal of pre-cut flap 49. As a result, fin 88 abuts the underside of lid 26, preventing prize holder 68 from being able to pass in its entirety through the opening formed in lid 26. In this way, this embodiment of the invention assures that no component of the prize holding system is capable of emerging from retained engagement within simulated product container assembly 50, thereby preventing any possibility that an injury might occur to a consumer upon opening container 20.

In addition, fin 88 and receiving slot 89 in combination with the overall configuration of prize holder 68 assures that the movement of prize holder 68 from its first position to its second, fully extended position, places prize holder 68 in a position which will enable the upper portion of prize holder 68 to pass through the open portal of lid 26, presenting the prize retained therein to the consumer. In this way, immediate knowledge and recognition of the prize award by the consumer is assured.

In order to assure that both simulated product container assemblies 21 and 50 are indistinguishable by the consumer from a genuine product bearing container, these embodiments of the simulated product container assembly are completely filled with a suitable liquid 90 which will provide the container assemblies with all of the identical physical attributes possessed by a genuine product container. Furthermore, simulated product container assemblies 21 and 50 are assembled in a manner substantially identical to the assembly of a genuine product bearing container in order to assure that liquid 90 provides the identical forces upon the inside walls of container shell 22 as is provided by the genuine product. However, in filling container shell 22 with liquid 90, the liquid level employed is less than a genuine product container, since the volume occupied by prize assembly holding member or housing 68 must be accommodated. Consequently, in filling shell 22 with liquid 90, the liquid is added to shell 22 to a preset level, which will be sufficient to completely fill shell 22 once housing 25/51 has been positioned in shell 22.

In the embodiments detailed above, prize assembly holding member or housing 25/51 is securely, integrally affixed to lid 26. In the preferred assembly process, circumferential sealing ring portion 38 of lid 26 is bonded directly to circular sealing ring 37/56 of flange 27/55 of housing 25/51. This particular bonded interengagement must be capable of withstanding internal pressures imparted thereon by liquid 90 and assure a leak-free sealed interengagement therebetween.

Once lid 26 has been intimately bonded to housing 25/51, the assembly of simulated product container assemblies 21 and 50 is completed by inserting housing 25/51 into shell 22, displacing the liquid 90 previously positioned therein and sealingly mounting lid 26 to shell 22 in the conventional manner. In this way, the desired prize awarding product container 20 is attained which is completely indistinguishable from genuine product bearing containers, while providing a completely reliable, trouble-free prize bearing assembly for awarding a predesignated prize to a lucky consumer.

In addition to providing a completely sealed, liquid-tight simulated product container assembly, which is indistinguishable from genuine product bearing containers, the sealing interengagement of lid 26 with housing 25 or 51 prior to affixing lid 26 to shell 22 also assures that the housing is positioned in the precisely desired orientation to assure the desired system activation when pre-cut flap 49 is moved. In the preferred embodiment, in order to provide assembly ease and accurate positioning, housing 25 and 51 incorporate a position defining flat surface 92 which is aligned with the forward edge of pre-cut flap 49, prior to sealingly engaging the housing with lid 26.

By incorporating flat surface 92 on the housing, a readily identifiable reference location is established for positioning lid 26 relative to housing 25/51 prior to sealingly affixing lid 26 to the housing. In this way, rapid and accurate assembly is assured, while the precisely desired position and alignment required for trouble-free operation is established. As a result, a simulated product is attained which can be manufactured quickly and easily, with a minimum of parts and provides dependable, repeatable, trouble-free operation.

In the foregoing embodiments, prize awarding product container 20 has been disclosed in its simulated product configuration, wherein prize awarding product container 20 comprises an external appearance which is indistinguishable from the genuine product container, but is devoid of actual product and, instead, contains an audible/visual message delivery assembly of the present invention either independently or in combination with an actual prize award. However, as detailed above, the present invention is not limited to use as a simulated product container and, instead, can be employed in any desired product container, whether such product is dry, wet, or moist. In addition, depending upon the particular embodiment of the present invention desired, visual-/audible message delivery assembly 24 of the present invention can be mounted in the actual product bearing container either independently or, if desired, in combination with the actual prize award or a certificate for the prize award.

Figure 18:
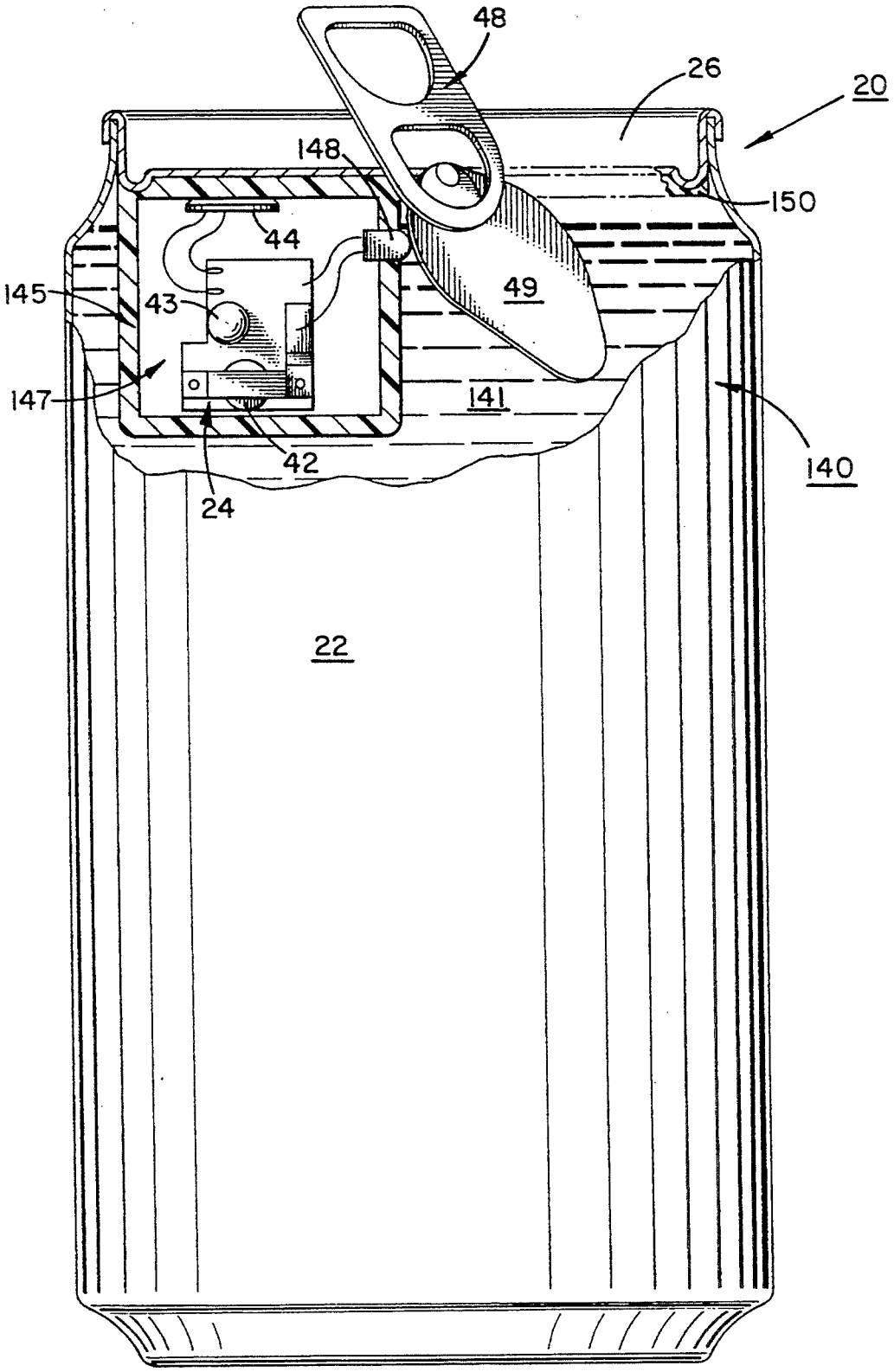
FIG. 18 is a side elevation view, partially in cross-section of a further embodiment of the prize awarding container of the present invention depicting a message delivery system mounted in a container in direct association with a liquid product.

In order to more fully understand these embodiments of the present invention, reference should be made to FIGS. 14, 17 and 18 wherein typical product bearing containers are depicted. In FIG. 14, product container 100 is depicted as a typical container employed for housing a liquid product, such as bleach, or detergent, which is represented as product 101, while FIG. 18 depicts a conventional beverage container with the actual beverage retained therein along with message delivery system 24. In FIG. 17, product container 120 is depicted as a typical box container for a dry product, represented by soap powder 123. However, without departing from the scope of the invention, container 120 may comprise any container for dry consumer products such as cereals, soaps, detergents, snack foods, and the like. Consequently, any dry, wet or moist product is considered to be within the scope of the present invention.

In these embodiments, audible/visual message delivery system 24 is distributed in direct association with the product in container 100, 120, or 140. Consequently, the consumer not only receives a prize award, but also is capable of enjoying the actual product for which the container is purchased. However, with container 100, 120 or 140 completely sealed, the consumer is unaware whether the container selected by the consumer constitutes a prize awarding product container.

In the embodiment depicted in FIG. 14, message delivery system 24 is mounted in a housing 104 which is constructed for easy removal through the portal opening of container 100. As a result, depending upon the configuration of container 100, housing 104 can be formed in any desired size, shape or overall configuration which will enable housing 104 to be easily positioned within container 100 in association with product 101, as well as easily removed from container 100 through its normal portal opening. Although housing 104 is shown as submerged in product 101, housing 104 can be constructed to float on the top surface of product 101 or be mounted in association with the cap or cover of container 100, thereby providing immediate visibility of housing 104 upon opening container 100. In addition, if desired, housing 104 can be secured to an inside surface of container 100 to assure that the presence of housing 104 cannot be detected by shaking container 100.

Figure 15:
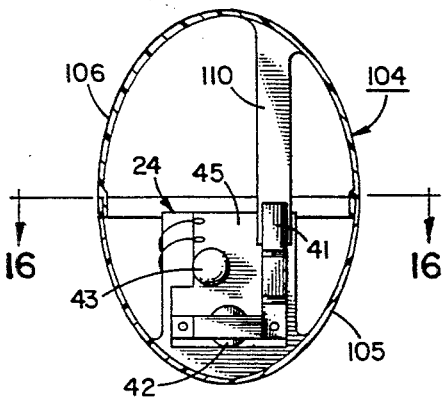
FIG. 15 is a cross-sectional plan view of the housing of FIG. 14 for secretly retaining the message delivery system of the present invention for distribution in a product bearing container.
Figure 16:
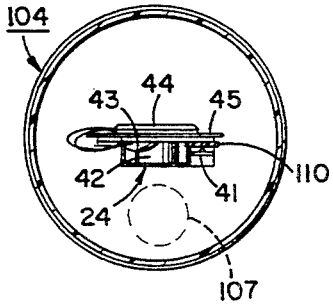
FIG. 16 is a cross-section elevation view of the housing taken along line 16—16 of FIG. 15.

In FIGS. 14–16, housing 104 is depicted, for exemplary purposes only, as comprising an overall egg or oval shape formed by mating sections 105 and 106. In this embodiment, sections 105 and 106 of housing 104 incorporate terminating ends which are constructed for mating, locked, liquid-tight interengagement with each other, thereby providing housing 104 with the ability of being positioned in a liquid product, without allowing any of the liquid entering housing 104 and causing degradation of message delivery system 24.

Any desired conventional locking system can be employed for sections 105 and 106, such as a threaded zone or liquid-tight snap connections. In addition, sealing tape can also be used to assure that a liquid-tight interengagement is established.

In FIG. 15, message delivery system 24 is shown securely mounted in section 105 of housing 104. Depending on the orientation desired, message delivery system 24 can be mounted In any desired location or surface thereof. In addition, housing 104 may also incorporate, if desired by the manufacturer, an actual prize award or certificate for a prize award. This is depicted in FIG. 16 as rolled currency, shown in phantom, as prize award 107.

Audible and/or visual message delivery system 24 preferably comprises substantially the same construction detailed above. In this regard, message delivery system 24 incorporates a switch 41, battery 42, and an integrated circuit 43, all of which are mounted on printed circuit board 45. In addition, an amplifier 44 is connected to message delivery system 24 and is mounted in a convenient place to assure any audible message is easily heard by the consumer. Preferably, amplifier 44 is mounted on a surface of printed circuit board 45, thereby rendering the mounting of message delivery system 24 in housing 104 easy to achieve.

If the product distributor has elected to include the actual prize award 107, the prize award would also be mounted or contained within housing 104. In this embodiment, integrated circuit 43 of message delivery system 24 would-preferably comprise an inexpensive, tone-generating chip which is pre-programmed to produce a particular song or melody when activated. With the actual prize award positioned within housing 104, message delivery system 24 is employed to further enhance the excitement and thrill of winning a prize while providing a musical background, which commences precisely at the moment a consumer opens housing 104.

Of course, if any other integrated circuit is desired, such as multiple tones, melodies, multiple tunes, or synthesized voice messages, these embodiments may be employed without departing from the scope of this invention, In addition, light sources can also be employed separately or in combination with an audible message, all contained within housing 104, in order to further enhance the excitement and thrill of winning a prize award.

If the manufacturing distributor of product 100 desires to employ message delivery system 24 as the sole means for indicating to the consumer the prize that has been won, a particular desired embodiment of message delivery system 24 would be mounted within housing 104 to provide the consumer with the desired message, indicating the particular prize award that has been won. In this regard, commercially available integrated circuits can be employed to generate one or more of a plurality of different songs, with specific songs or song combination being pre-selected to represent particular prize awards. By informing the consumer of the particular song or song combinations that are associated with each prize award, the consumer would immediately know which prize has been won by the particular song or melody generated by message delivery system 24 upon opening of housing 104.

In an alternate embodiment, specially constructed integrated circuits are employed to produce a synthesized voice message informing the consumer of the particular prize that has been won. If desired, songs or background music can also be generated by/message delivery system 24 to further enhance the excitement attained by the consumer upon learning that a prize has been won.

To further add excitement or thrill enhancement to the moment a consumer realizes that a prize awarding container has been opened, message delivery system 24 may also incorporate one or more LED's or other light source to provide a light display ranging from a single blinking light as the sole visual message to a fully integrated, multi-colored illumination display timed to the music and voice message which simultaneously communicates to the consumer the precise prize that has been won. In addition, message delivery system 24 can be constructed to continuously repeat the audible or visual message, until battery power is lost, or constructed to provide the message a single time or repeat the message any desired number of times. As is apparent from this detailed disclosure, message delivery system 24 may be selected from a wide range of alternate constructions or combinations, without departing from the scope of this invention.

Regardless of the particular embodiment employed, message delivery system 24 is securely contained within housing 104 with switch 41 thereof being maintained in the normally open or "off" position, preventing any message from being delivered by message delivery system 24. Although various means for activating message delivery system 24 can be employed, one system is shown in detail in FIGS. 15 and 16.

In this embodiment, switch 41 is maintained in the open or "off" position by elongated finger 110 which is formed on section 106 of housing 104 and extends therefrom into aligned engagement between switch 41 and the surface contact of printed circuit board 45. In this way, with finger 110 positioned between switch 41 and the contact of board 45, message delivery system 24 is maintained in the "off" position.

In normal use, housing 104 would be positioned within container 100 in supporting contact with product 101. Since product 101 is depicted as a liquid product, housing 104 is maintained in a sealed condition, preventing any liquid from entering housing 104. In this way, no degradation of message delivery system 24 is experienced.

Upon opening container 100, the consumer would either observe the presence of housing 104 or would be informed that housing 104 is contained therein. Then, the consumer would remove housing 104.

Instructions printed on housing 104 would inform the consumer on the manner in which to open housing 104 by separating sections 105 and 106. Upon separation of section 106 relative to section 105, finger 110 is moved out of aligned relationship with switch 41, causing switch 41 to move into contact with board 45, completing the circuit and activating message delivery system 24. In this way, message delivery system 24 is immediately activated, providing the desired verbal and/or audio message to the consumer simultaneously with the opening of housing 104.

In FIG. 17, product container assembly 120 is depicted as comprising a conventional cardboard container or-box 122 in which a typical dry product 123 is retained. Product 123 is depicted as conventional dry soap powder, for exemplary purposes only, and as is apparent from this detailed disclosure, product 123 may comprise any dry product such as cereal, snack foods, laundry products, animal foods, and the like.

Product container assembly 120 also incorporates a housing 125 in which message delivery system 24 is securely retained. In this embodiment, housing 125 comprises a sealed package, such as a cellophane package, which securely retains message delivery system 24 and prevents product 123 from contacting or adversely affecting message delivery system 24.

As depicted, housing 125 is packed inside box 122 completely surrounded by product 123. However, if desired, housing 125 may be positioned on the top surface of product 123 in order to make housing 125 immediately visible upon opening box 122. If housing 125 is packed below the surface of product 123, a message is preferably printed inside box 122 to inform the consumer upon opening box 122 that housing 125 is packed therein.

In addition, housing 125 also preferably incorporates a contact engaging finger 127, which is similar to the finger 110 detailed above, and is employed to prevent message delivery system 24 from being activated while housing 125 is in the sealed or closed configuration. However, upon opening housing 125, contact separating finger 127 is removed from switch 41 of message delivery system 24, activating the message delivery system and providing the consumer with the desired visual or audible message.

In the embodiment depicted in FIG. 17, only message delivery system 24 is mounted in housing 125. In this embodiment, the prize award corresponds to the particular tune or song being played by message delivery system 24, or, alternatively, a synthesized voice generating circuit 23 would be employed as integrated circuit 43 of message delivery system 24, providing the consumer with a precise voice generated detailed description of a particular prize award that has been won by the consumer.

As is apparent from the preceding description, housing 125 can be formed in any desired configuration with any size and shape. In addition, if desired, a rigid housing, similar to housing 104 detailed above, could also be employed so that a visual message delivery system can be incorporated therein instead of, or in addition to, the audible message delivery system. Regardless of the particular visual and/or audible message incorporated in product container assembly 120, this embodiment of the present invention clearly depicts the manner in which the message delivery system 24 of the present invention is employed with dry products, as well as with the liquid products detailed above.

Of course, if an actual prize is desired to be awarded along with message delivery system 24, the desired prize would also be mounted within housing 125 with housing 125 constructed to retain both message delivery system 24 and the desired prize award. As is apparent from the preceding detailed disclosure, the message delivery system of the present invention is constructed to provide a wide range of audible and/or visual messages to either inform the consumer of the precise award that has been won or to provide a visual or audible accompaniment to the presence of an actual prize award being won by the consumer. In this way, the excitement of winning a prize award is further enhanced or, alternatively, the message delivery system provides the consumer with the precise notification of the prize that has been won.

In the embodiment of the present invention depicted in FIG. 18, prize awarding product container 20 comprises a product container assembly 140 which comprises a conventional liquid holding can, typically employed for beverages, such as soda, beer, juices, etc. In this embodiment, the actual beverage 141 is sealingly retained within the conventional can shell 22, so that the consumer is capable of enjoying the beverage expected to be received upon purchasing product 140, while also obtaining, without advance knowledge, prize awarding message delivery assembly 24.

As with the embodiments detailed above, product container assembly 140 is completely indistinguishable from a non-prize awarding product container. As a result, prize awarding product container assembly 140 comprises an external appearance identical to non-prize awarding product containers as well as being identical to such non-prize awarding containers in both sound, weight and feel. As a result, the consumer is incapable of determining, in advance, whether a product container being held represents a product only container or a prize awarding product container.

In order to attain this virtual identity, prize awarding product container assembly 140 comprises an outer can shell 22 which is identical to the can shell employed by the manufacturer or bottler for the liquid product 141 contained therein. In FIG. 18, liquid product 141 is represented as comprising a consumable soft drink beverage. However, any other consumable or non-consumable liquid product could employ this invention with equal efficacy.

In this embodiment, prize awarding product container assembly 140 incorporates a housing 145 which is completely closed and sealed, defining a cavity 147 therein. In the preferred construction, audible/visual message delivery system 24 is mounted in cavity 147 of housing 145. As detailed above, audible/visual message delivery system 24 comprises a battery or an equivalent power means 42, an integrated circuit 43, and an amplifier 44. Finally, in order to activate integrated circuit 43 for providing the desired audible/visual message, message delivery system 24 also incorporates activation means 148.

In this embodiment, as depicted in FIG. 18, activation means 148 comprises a diode or light detector. In this way, when prize awarding product container 140 is completely sealed, tab release assembly 48 and flap 49 of lid 26 are in their normally closed and sealed position, preventing any light from entering shell 22. As a result, message delivery system 24 is maintained in its off mode.

As soon as tab release assembly 48 is opened, flap 49 pivots inwardly into shell 22, allowing light to enter the inside of shell 22. This causes light sensing diode, forming the actuation means 148, to be activated, effectively switching message delivery system 24 from its off mode to its on mode.

Once activated, message delivery system 24 is initiated and provides the desired audible or visual message to the consumer. In this way, the consumer is immediately informed that the container that has just been opened is a prize awarding container and the consumer can now enjoy the benefits of having won a prize, as well as being capable of enjoying beverage 141 contained within shell 22.

As detailed above, message delivery system 24 may provide a particular tune or song which designates a particular prize that has been won. Alternatively, integrated circuit 43 of message delivery system 24 comprises a synthesized voice generating circuit which announces to the consumer a precise voice generated detailed description of the particular prize award that has been won.

In FIG. 18, amplifier 44 of message delivery system 24 is shown mounted to a portion of housing 145 within cavity 147. However, if desired, amplifier 44 may be extended through housing 145 and be mounted outside cavity 147 with the connecting wires therefrom being sealed in order to assure that no beverage 141 enters cavity 147. Similarly, the portal in which activation means 148 is mounted is similarly sealed, in order to prevent any beverage 141 from seeping therethrough into cavity 147.

In the preferred embodiment, housing 145 is securely affixed to shell 22 and lid 26 during the sealing operation when lid 26 is normally affixed to shell 22. In order to provide the secure interlockingly affixed mounted interengagement, housing 145 preferably comprises a peripherally surrounding flange 150 formed as a portion of the top surface of housing 145. In addition, flange 150 is preferably constructed for mating, locked, secure interengagement between shell 22 and lid 26, in order to assure that flange 150 and housing 145 are securely mounted in the precisely desired location, in a manner which prevents disconnection or dislodgement therefrom.

If desired, flange 150 may be formed substantially surrounding the entire closed portion of lid 26, except for the zone about which flap 49 is formed. In this way, secure, mounted, affixed interengagement of flange 150 and housing 145 with lid 26 and shell 22 is assured, while also providing for the delivery of the liquid beverage 141 through the portal formed by flap 49 when opened. However, if desired, flange 150 may be formed with any desired area of coverage without departing from the scope of this invention.

Furthermore, sealed housing 145 may be affixed to lid 26 is a plurality of alternate constructions. One such alternate construction is to fasten one surface of housing 145 to the inside surface of lid 26 by suitable bonding or adhesive means. Alternatively, a similar flange construction as detailed above could be employed, with the flange being bonded, glued or adhesively sealed to shell 22 and lid 26. However, regardless of the method employed for securely affixing sealed housing 145 in the precisely desired position, directly adjacent the portal formed in lid 26 by flap 49, all variations are intended to be within the scope of this invention.

Figure 19:
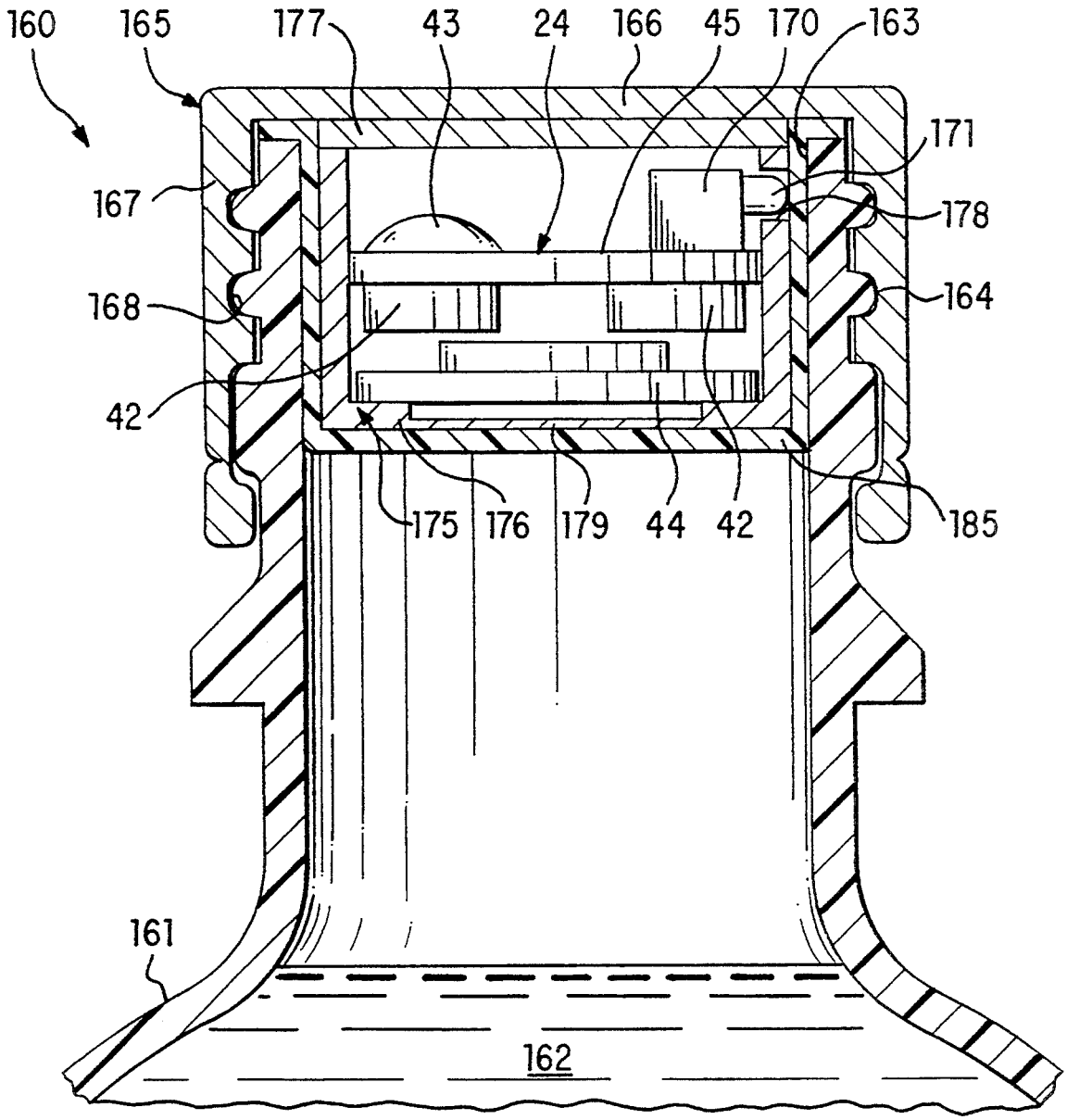
FIG. 19 is a side elevation view, partially in cross-section of a further embodiment of the prize awarding container of the present invention depicting a message delivery system mounted in association with the entry portal of a liquid product holding container and a removable cap therefor.

In FIG. 19, a further alternate embodiment of the present invention is depicted wherein prize awarding product container 20 comprises a product container assembly 160 which consists of a generally conventional liquid product holding container or shell 161. Container or shell 161 represents the type of container typically employed with liquids distributed in plastic or glass bottles. These containers may be formed either from transparent material, translucent material, or optically colored material.

Typically, container or shell 161 is employed for beverages such as soda, juice, water, wine, beer, liquor, and the like. In addition, non-edible products, such as bleaches, automotive oils, additives, detergents, soaps, and the like are also distributed in similar containers or shells. In addition, solid products, such as soaps, laundry detergents, etc., may also be sold in container or shell 161. For exemplary purposes, container or shell 161 is depicted as formed from a transparent plastic material which incorporates a liquid beverage 162. Although container 161 is depicted and described as holding a liquid product, container 161 may be used for other products, such as solids or moist products.

In the preferred embodiment, the actual product 162 typically distributed in container or shell 161 is retained within container 161 so that the consumer is able to enjoy the product expected to be received upon purchasing product container assembly 160. By employing this embodiment of the present invention, the consumer is able to enjoy or use product 162, while also having a chance to find prize awarding message delivery assembly 24 secretly retained within product container assembly 160, in a manner which prevents advance discovery prior to opening product container assembly 160.

As shown in FIG. 19, liquid holding container or shell 161 comprises a generally conventional glass or plastic bottle incorporating a portal 163, through which beverage product 162 is dispensed. Portal 163 is peripherally surrounded by an externally positioned threaded zone 164.

In order to sealingly enclose beverage 162 in container or shell 161, cap 165 is employed. Cap 165 is preferably constructed to peripherally surround and sealingly close portal 163 by threadedly engaging threaded zone 164 of container 161. In this way, secure, sealed, tamper-free closure of product container assembly 160 is attained.

The container construction shown in FIG. 19 is merely for exemplary purposes and is not, in any way, intended to limit the scope of the present invention. As is readily apparent to one of ordinary skill in the art, numerous alternate closure systems or cap securement arrangements are presently employed with both glass and plastic containers or shells. Each of these alternate structures can be employed in the present invention, without departing from the scope thereof. As a result, threaded cap 165 is shown herein as one example of the plurality of alternate closure systems which are intended to be within the scope of this invention.

In the embodiment depicted in FIG. 19, cap 165 comprises a standard screw cap incorporating a top surface member 166 and a depending, substantially cylindrically shaped side wall 167 peripherally surrounding and extending from top surface member 166. In addition, threads 168 are formed in cylindrically shaped side wall 167 to enable cap 165 to be threadedly engaged with thread means 164 of bottle 161.

Preferably, side wall 167 of cap 165 comprises an overall height or extending distance from top surface member 166 which is greater than the vertical height of message delivery system 24. In this way, the presence of message delivery system 24 within portal 163 of liquid holding container or shell 161 is visually obscured, preventing a consumer from being able to detect the presence of a prize delivery system 24 in advance of purchasing product container assembly 160.

In the preferred construction of this embodiment, message delivery system 24 is mounted in housing 175 which comprises a substantially cylindrically shaped closed-end cup member 176. Cup member 176 is dimensioned for sliding interengagement within portal 163 of liquid holding container 161. In the preferred embodiment, housing 175 also incorporates an aperture 178 formed in the side wall of cup member 176 and cover 177, which is constructed for overlying, mating, interengagement with cup member 176 for being sealingly affixed thereto. In this way, message delivery system 24 is securely sealed within housing 175.

As detailed above, message delivery system 24 incorporates integrated circuit 43, mounted to printed circuit board 45, to which batteries 42,42 are also mounted. Speaker or amplifier 44 is connected to integrated circuit 43, in order to deliver the desired audible output.

In order to control the initiation of message delivery system 24, when desired, message delivery system 24 incorporates activation means which comprises, in this embodiment, a pressure activation switch 170. Pressure activation switch 170 incorporates a movable toggle 171 which is constructed to either initiate the delivery of a pre-recorded message or terminate the delivery of such message. In this embodiment, pressure switch 170 is constructed to deactivate message delivery system 24 whenever toggle 171 is in a first inwardly disposed position, as depicted in FIG. 19, while initiating the delivery of the pre-recorded message whenever toggle 171 is moved from this first position to its fully extended outwardly biased position.

As with the embodiments detailed above, product container assembly 160 is completely indistinguishable from non-prize bearing product containers. As a result, prize awarding product container assembly 160 comprises an external appearance identical to non-prize bearing product containers, as well as being identical to such non-prize bearing containers in both size, weight, and feel. As a result, the consumer is incapable of determining, in advance, whether any particular product container being held by a consumer represents a product only container or a container also incorporating the prize awarding message delivery system of this invention.

In order to attain this visual and sensory identical construction, prize bearing product container assembly 160 is constructed with cover 177 of housing 175 mounted to the inside surface of cap 165. In this way, in the preferred embodiment, secure mounted interengagement of message delivery system 24 within housing 175 is attained most efficiently and its secure, suspended, trouble-free integration with liquid holding container or shell 161 is easily and efficiently attained.

In this construction, pressure switch 170 is mounted to circuit board 45, with toggle 177 extending through aperture 178 of housing 175. With message delivery system 24 securely mounted in the desired position within housing 175 and with housing 175 positioned within portal 163 of liquid holding container 161, toggle 171 is maintained in its fully retracted position, preventing message delivery system 24 from being activated into its message delivery mode. However, whenever cap 165 is removed from bottle 161, and housing 175 is withdrawn therewith, the holding force maintaining toggle 171 in its fully retracted position is removed, and toggle 171 moves outwardly through aperture 178, causing message delivery system 24 to be activated. In this way, the desired prize awarding message is delivered to the consumer as soon as liquid holding container 161 has been opened.

Once activated, message delivery system 24 is initiated and provides the desired audible or visual message to the consumer. In this way, the consumer is immediately informed that liquid holding container 161 is a prize awarding container and the consumer is now able to enjoy the knowledge that a prize has been won. In addition, in this embodiment, the consumer is also able to enjoy the particular beverage 162, retained within container 161.

As detailed above, depending upon the particular construction desired, message delivery system 24 may provide a particular tune or song which designates a particular prize that has been won. Alternatively, integrated circuit 43 of message delivery system 24 may comprise a synthesized voice generating circuit which announces to the consumer a precise voice generated detailed description of the particular prize award that has been won.

In the preferred construction, amplifier 44 is mounted in the base of housing 175 with printed circuit board 45 securely mounted within housing 175 in juxtaposed, spaced relationship to amplifier 44. In order to assure that the consumer is capable of easily hearing the entire audible message delivered by message delivery system 24, the closed end base of cylindrically cup member 176 preferably incorporates a centrally disposed zone 179, wherein the material forming cylindrically shaped closed end cup member 176 is substantially reduced in thickness. In this way, the clear transmission of all audible messages provided by amplifier 44 through housing 175 is assured and the consumer is able to hear the entire message with complete clarity.

As detailed above, in order to provide a secure, sealed, integrated structure, cylindrically shaped, closed end cup member 176 is bounded or fixed to cover 177. In addition, in the preferred construction, cover 177 is securely affixed to the inside surface of cap 165. In this way, housing 175 and message delivery system 24 are easily inserted within product holding container 161 simultaneously with the affixation of cap 165 to container 161. However, if desired, alternate constructions can be employed without departing from the scope of this invention. In particular, housing 175 can be constructed as a separate insert for being placed within portal 163 of product holding container 161 prior to the affixation of cap 165 therewith.

In this alternate embodiment, cap 165 would first be removed, revealing the presence of sealed housing 175 in product delivery portal 163 of container 161. Instructions would be provided on the top surface of cover 177 to inform the consumer of the desired method for removing housing 175 from container 161. Once removed, pressure switch 170 would be activated by the movement of toggle 171, thereby initiating the delivery of the desired audible prize related message.

In the preferred embodiment depicted in FIG. 19, product container assembly 160 also incorporates cylindrically shaped sealing member 185 which peripherally surrounds housing 175 and is dimensioned for providing a liquid sealing engagement of housing 175 in portal 163 of product holding container 161. By employing cylindrically shaped sealing member 185, assurance is provided that liquid product 162 is incapable of reaching message delivery system 24, thereby eliminating any possibility that a malfunction would occur.

Regardless of any manipulation of product container assembly 160, such as tipping or inversion of container 161 in its entirety, liquid product 162 will contact cylindrically shaped sealing member 185, but will be prevented from passing beyond the bottom surface of sealing member 185. In addition, in order to provide further assurance that message delivery system 24 is incapable of being harmed by any liquid product entering housing 175, housing 175 is, in itself, completely sealed with cover 177 bonded to the only open end of cylindrically shaped cup member 176. In this way, complete assurance is provided that message delivery system 24 is sealingly retained within housing 175 in a manner which prevents any possibility that the liquid product 162 can reach message delivery system 24 in a manner which will cause harm or malfunction of message delivery system 24.

Depending upon the construction desired, cylindrically shaped sealing member 185 can be affixed in portal 163 of product holding container 161 with housing 175 telescopically mounted into cylindrically shaped sealing member 185 during the affixation of cap 165 to container 161. Alternatively, cylindrically shaped sealing member 185 can be affixed directly to the inside surface of cap 165 in peripheral surrounding, protected envelopment of housing 175. In this way, both housing 175 and sealing member 185 are simultaneously inserted into portal 163 of product holding container 161 during the mounting of cap 165 to container 161.

In order to further enhance and eliminate any possibility that sealing member 185 or housing 175, if sealing member 185 is not used, can be detected by visual inspection of liquid holding container or shell 161, the bottom surface of sealing member 185 or housing 175 may comprise a metallized or mirrored surface. In this way, when sealing member 185 or housing 175 is mounted in position within holder 163 of liquid holder container or shell 161, the surrounding surfaces of container or shell 161 will be reflected and the appearance of beverage 161 being fully contained therein will be seen.

Consequently, regardless of the manner in which prize bearing container 160 is tilted for viewing, the mirrored, polished and metallized surface of sealing member 185 or housing 175 will reflect the surrounding environment, eliminating any possibility that the presence of sealing member 185 or housing 175 could be detected. In this way, prize bearing container 160 can be randomly distributed on the shelf with non-prize bearing product containers so that lucky consumers randomly selecting prize bearing container 160 will receive the prize award as a complete surprise, without any prior knowledge that the message delivery system 24 is present in the particular bottle.

As is apparent from the preceding detailed disclosure, the present invention, regardless of the actual construction employed, contemplates all configurations which would incorporate a message delivery system sealingly mounted in a chamber, with the chamber securely affixed in direct association with the portal through which the liquid product retained in the container is delivered. In this way, the actual product being sought by the consumer is contained in the conventional holding can or container, while also providing the enhanced purchase incentive that some containers comprise prize awarding product container assemblies. As a result, the consumer is capable of enjoying both the product and the joy in succeeding in winning a prize award.

In addition, as detailed above, the visual/audible message delivery system of the present invention can be incorporated in either dry, wet, or moist products, to enable the manufacturers of these products to substantially increase sales and excitement in the promotional efforts conducted with awarding prizes in prepackaged product containers. In addition, the present invention also encompasses the use of simulated product containers in which message delivery systems are housed, either independently, or in association with a prize award, with the simulated product containers being distributed with genuine product containers in a manner totally indistinguishable from the genuine product containers. In this way, consumers of either dry, wet or moist product selecting a product from the store shelves are surprised to learn, when the product is opened for use, that a prize has been won.

It will thus be seen that the objects set forth above among those made apparent from the preceding description, are efficiently attained and, since certain changes may be made in the above products, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A container assembly, for use in association with liquid, semi-liquid and moist products, constructed for housing a prize award and being randomly distributed with non-prize bearing containers without being detected by the consumer prior to opening thereof, said container assembly comprising:

A. An outer surface defining shell
  a. identical in appearance to the product bearing shell normally employed for the liquid, semi-liquid or moist product;
  b. defining an internal retaining zone; and
  c. comprising at least one entry portal formed at one end thereof;

B. closure means cooperatively associated with the outer shell closing the entry portal thereof;

C. means positioned in the retaining zone for providing the container assembly with the sound, weight and feel of the product normally contained therein;

D. housing means positioned immediately adjacent the entry portal in cooperating relationship therewith; and E. a message delivery system
  a. mounted in the housing means,
  b. constructed for providing a prize related audible message to the consumer upon activation, and
  c. comprising activation means cooperatively associated with the entry portal for preventing the delivery of the prize related audible message when the housing is positioned within the entry portal, and initiating the delivery of the desired audible message upon removal of the housing from the portal;

whereby a prize award holding container assembly for liquid, semi-liquid and moist products is achieved for being randomly distributed with non-prize bearing, product-holding containers without fear of being detected by the consumer prior to opening thereof.

2. The container assembly defined in claim 1, wherein the activation means is further defined as comprising a pressure activation switch.

3. The container assembly defined in claim 2, wherein the pressure activation switch comprises a movable toggle
  1. cooperatively associated with the housing means,
  2. movable between a first open position, preventing the delivery of the audible message, and a second closed position, enabling the audible message to be delivered, and
  3. positioned for cooperative association with the entry portal for being maintained in its first position when the housing means is positioned within the entry portal, and being automatically biased into its second position whenever the housing means is withdrawn from the inlet portal.

4. The container assembly defined in claim 3, wherein the message delivery system is further defined as comprising:
  c. an integrated circuit programmed to provide the desired audible message, and
  d. power means connected to the integrated circuit for powering the integrated circuit.

5. The container assembly defined in claim 4, wherein the message delivery system is further defined as providing an audible message and said system further comprises
  e. amplifier means connected to the integrated circuit for providing the audible message programmed into the integrated circuit.

6. The container assembly defined in claim 5, wherein said audible message is further defined as comprising one selected from the group consisting of tones, melodies, songs, and simulated voice messages informing the consumer about a prize award.

7. The container assembly defined in claim 4, wherein said message delivery system is further defined as providing a visual message and said system further comprises
  e. light means connected to the integrated circuit for providing a visual message programmed therein.

8. The container assembly defined in claim 5, wherein said means positioned in the retaining zone is further defined as comprising the actual liquid, semi-liquid or moist product being sold.

9. The container assembly defined in claim 8, wherein said housing means is further defined as comprising a substantially cylindrically-shaped cup member a. open at one end thereof and closed at the opposed end; and b. dimensioned for telescopic, cooperative alignment with the inside wall of the entry portal of the outer shell.

10. The container assembly defined in claim 9, wherein the closure means is further defined as comprising a cap engageable with the outer peripheral surface of the shell, directly adjacent the entry portal, thereby peripherally surrounding and visually obscuring the presence of said holding means.

11. The container assembly defined in claim 10, wherein said cup member is further defined as being removably mounted in the entry portal of the outer shell for providing access to the product contained in said shell.

12. The container assembly defined in claim 11, wherein said cup member is further defined as being securely affixed to a surface of the cap for being removably aligned with the entry portal simultaneously with the engagement and disengagement of the cap with the shell.

13. The container assembly defined in claim 12, wherein the housing means is further defined as comprising a cover sealingly affixed to the open end of the cup member for securely sealing the message delivery system therein, thereby preventing contamination of the message delivery system by the product.

14. The container assembly defined in claim 13, wherein said cover is affixed to the cap for securely mounting the housing means thereto.

15. The container assembly defined in claim 12, wherein said shell is further defined as comprising d. a bottle typically associated with liquid products.

16. The container assembly defined in claim 11, and further comprising

F. a sealing member peripherally surrounding and enveloping the housing means, and constructed for telescopic removable engagement with the entry portal.

17. The container assembly defined in claim 16, wherein said sealing member is securely mounted to the cap for being removably engaged with the entry portal simultaneously with the cap.

18. The container assembly defined in claim 16, wherein said sealing member comprises a flange portion integrally engaged with and peripherally surrounding the upper edge thereof and dimensioned for retaining engagement about the top edge of the entry portal.

* * * * *